US011589613B2

(12) United States Patent
Ouyang

(10) Patent No.: US 11,589,613 B2
(45) Date of Patent: Feb. 28, 2023

(54) POWER SUPPLY ASSEMBLY FOR ELECTRONIC CIGARETTES

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 420 days.

(21) Appl. No.: 16/931,561

(22) Filed: Jul. 17, 2020

(65) Prior Publication Data

US 2021/0022393 A1 Jan. 28, 2021

(30) Foreign Application Priority Data

Jul. 22, 2019 (CN) ..... 201910660541.X

(51) Int. Cl.
*A24F 13/00* (2006.01)
*A24F 40/40* (2020.01)
*A24F 40/50* (2020.01)

(52) U.S. Cl.
CPC ..... *A24F 40/40* (2020.01); *A24F 40/50* (2020.01)

(58) Field of Classification Search
CPC ..... A24F 47/00
USPC ..... 131/328–329
See application file for complete search history.

(56) References Cited

U.S. PATENT DOCUMENTS

2015/0333561 A1* 11/2015 Alarcon ..... A24F 40/90 131/329
2020/0008466 A1* 1/2020 Ouyang ..... H05B 1/0297

* cited by examiner

*Primary Examiner* — Phuong K Dinh
(74) *Attorney, Agent, or Firm* — Thompson Hine LLP

(57) ABSTRACT

The present disclosure discloses a power supply assembly for an electronic cigarette and an electronic cigarette. The power supply assembly includes a main body and a trigger switch. The main body may be provided with an accommodation space for accommodating circuit components. The trigger switch may be mounted inside the accommodation space by a seal. A first channel and an air flow sensing duct may be connected to the trigger switch. The first channel may include a first end and a second end that are arranged oppositely. The first end may communicate with the air suction pathway of an atomizer of the electronic cigarette, and the air flow sensing duct may communicate with a lateral wall of the first channel close to the first end.

18 Claims, 5 Drawing Sheets

POWER SUPPLY ASSEMBLY FOR ELECTRONIC CIGARETTES

CROSS-REFERENCE TO RELATED APPLICATION

This application claims priority to Chinese Patent Application No. 201910660541.X, filed on Jul. 22, 2019. The disclosure of the foregoing application is incorporated herein by reference in its entirety.

TECHNICAL FIELD

The present disclosure is related to the field of electronic cigarettes, particularly a power supply assembly for an electronic cigarette and an electronic cigarette thereof.

BACKGROUND

With the improvement of awareness on health, more and more people are aware of the risk of smoking cigarettes. During recent years, some simulated cigarette substitutes, such as electronic cigarettes, have appeared. Electronic cigarettes heat cigarette juice by atomizer to produce the smoke similar to cigarette taste for smoking, which have even more tastes than traditional cigarettes. Meanwhile, the electronic cigarette is gradually replacing the traditional cigarette in the market because it is free of tar, suspended particulates, and other harmful components in traditional cigarette.

In prior arts, operation of electronic cigarette may be controlled by a trigger sensor, after a certain period of operation, juice in the atomizer of electronic cigarette will flow to the trigger sensor along the air flow sensing duct of trigger sensor, which tends to affect normal operation of trigger sensor and is not good for long-term use of electronic cigarettes.

SUMMARY

The main purpose of present disclosure is to provide a power supply assembly of an electronic cigarette and an electronic cigarette, so as to solve the problem that leaking out juice tends to affect the trigger sensor in prior art.

To achieve above purpose, the present disclosure discloses a power supply assembly of electronic cigarette. The power supply assembly includes a main body and a trigger switch, the main body is provided with an accommodation space for accommodating circuit components, the trigger switch is mounted inside the accommodation space by a seal, wherein a first channel and an air flow sensing duct connected to the trigger switch are provided on the seals. The first channel includes a first end and a second end that are arranged oppositely. The first end communicates with the air suction pathway of atomizer for electronic cigarette, and the air flow sensing duct communicates with lateral wall of the first channel close to the first end.

Optionally, the second end of the first channel communicates with outside, so that leaking out juice can flow out of the power supply assembly through the first channel.

Optionally, the first channel may be arranged along the long axis direction of the power supply assembly.

Optionally, the air flow sensing duct may be arranged in the direction perpendicular to the first channel.

Optionally, an oil proof step may be provided on one side of the air flow sensing duct communicating with the first channel.

Optionally, the seal may be silicone solid, part of or whole the trigger switch may be encapsulated in the seals.

Optionally, the first channel may be arranged in a straight line.

Optionally, the power supply assembly further includes a first electrode with a first through hole, the first electrode may be airtightly connected to the seal, and the first channel communicates with outside through the first through hole.

Optionally, the main body further includes a bottom cover. A convex platform may be provided on the bottom cover, and a second through hole that communicates with the first channel may be provided on the convex platform, a groove that matches with the convex platform may be provided on the seal, and the groove matches with the convex platform, so that the bottom cover can be airtightly connected to the seal.

The present disclosure further discloses an electronic cigarette. The electronic cigarette includes an atomizer and above mentioned power supply assembly of electronic cigarette, the atomizer may be electrically connected to the power supply assembly, and the air suction port of the atomizer communicates with the first channel.

In the power supply assembly of electronic cigarette and the electronic cigarette disclosed in the embodiment of present disclosure, a first channel for juice flowing through is provided, and a first end of the air flow sensing duct close to the first channel is set, which will facilitate discharging or storing certain amount of juice in the second end of first channel and avoid accumulation of juice at the trigger switch, so as to ensure the normal use of electronic cigarette.

BRIEF DESCRIPTION OF THE DRAWINGS

For a more complete understanding of the present disclosure or the technical schemes in the prior art, the drawings in the embodiments or the description of the prior art are briefly introduced. Obviously, the drawings in the following description are only some embodiments of present disclosure, and it will be apparent to those skilled in the art from this disclosure that other drawings may be easily obtained from these drawings without paying any creative effort.

Figure 1:
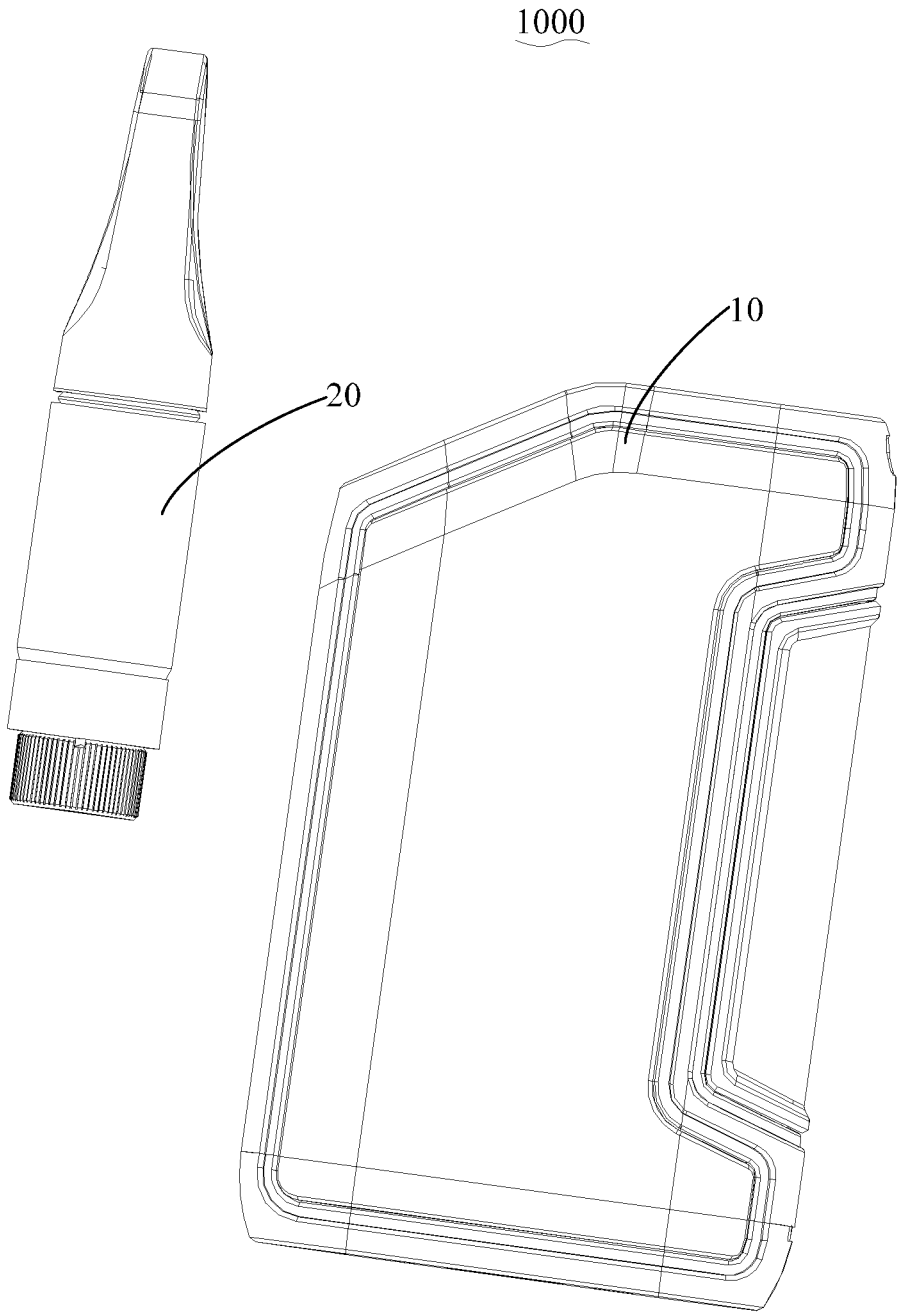
FIG. 1 is a disassembled structural schematic of electronic cigarette in the present disclosure.

Definition of reference numbers:

| Reference number | Name | Reference | Name |
|---|---|---|---|
| 10 | Power supply assembly | 100 | Main body |
| 101 | Accommodation space | 200 | Trigger switch |
| 300 | Seals | 310 | air flow sensing duct |
| 320 | First channel | 321 | First end |
| 322 | Groove | 400 | First electrode |
| 401 | First through hole | 410 | Probe |
| 500 | Bottom cover | 510 | Convex platform |
| 511 | Second through hole | 600 | Circuit board |
| 700 | Power source | 1000 | Electronic cigarette |
| 20 | Atomizer | 210 | Receiving space |
| 220 | Heating component | 230 | Air suction channel |
| 323 | Second end | 311 | Oil proof step |

The realization of objects, functional characteristics, and advantages of present disclosure will be further described in conjunction with the embodiments and with reference to the drawings.

DETAILED DESCRIPTION

Technical solutions based on embodiments of present disclosure are described clearly and completely in conjunction with the drawings in the embodiments of present disclosure hereinafter. Apparently, the described embodiments are only a few rather than all embodiments of present disclosure. Other embodiments obtained by those skilled in the art without any creative work based on the embodiments of present disclosure fall within the scope of protection of the present disclosure.

It should be noted that all directional indicators (such as up, down, left, right, front, back, etc.) in the embodiments of present disclosure are only used to explain the relative position between the components in a specific posture (as shown in the drawings) and movement conditions, etc. If the specific posture changes, the directional indication also changes accordingly.

In the description of present application, the "first" and "second" are merely used for description and cannot be understood to indicate or imply relative importance or implicitly indicate the number of the indicated technical features. Therefore, features with a limitation of "first" or "second" can explicitly or implicitly include one or more feature.

Furthermore, technical schemes of various embodiments can be combined with each other if only it can be implemented by those of ordinary skill in the art. If a combination of the technical schemes is conflict or impracticable, the combination should be considered as nonexistent and not fall in the scope of protection of present disclosure.

In the present disclosure, unless otherwise clearly stated and limited, terms "connect" and "fix" should be understood broadly, for instance, "fix" can be a fixed connection, a detachable connection, or an integral connection, it can be a mechanical connection and an electrical connection, it can be a direct connection, an indirect connection by an intermediary, and an internal communication of two elements, unless otherwise clearly limited. A person skilled in the art can understand concrete meanings of terms in the present disclosure as per specific circumstances.

With reference to FIG. 1-FIG. 5, the present disclosure discloses an electronic cigarette 1000, the electronic cigarette 1000 includes an atomizer 20 and a power supply assembly 10 supplying electric power to the atomizer 20. An air suction pathway 230 and a receiving space 210 for accommodating juice or tobacco products are provided inside the atomizer 20, and a heating component 220 may be provided inside the air flow channel. When the atomizer 20 is installed on the power supply assembly 10, the heating component 220 will be electrically connected to the power supply assembly 10. The heating component 220 heats the juice or tobacco products stored inside the atomizer under the current, so as to produce smoke for the user to smoke. The power supply assembly 10 may be further provided with a trigger switch 200 for start/stop the operation of electronic cigarette 1000, and the air suction pathway 230 in the atomizer 20 communicates with the air flow sensing duct 310 in the trigger switch 200, so that the trigger switch 200 may real-timely control the electronic cigarette 1000 when the user smokes the electronic cigarette 1000.

The present disclosure discloses a power supply assembly 10 of electronic cigarette 1000. The power supply assembly 10 includes a main body 100 and a trigger switch 200, the main body 100 may be provided with an accommodation space 101 for accommodating circuit components, and the trigger switch 200 may be mounted inside the accommodation space 101 by seals 300, wherein a first channel 320 and an air flow sensing duct 310 connected to the trigger switch 200 are provided on the seals 300. The first channel 320 includes a first end 321 and a second end 323 that are arranged oppositely, the first end 321 of the first channel 320 communicates with the air suction pathway 230 of atomizer 20 for electronic cigarette 1000, and the air flow sensing duct 310 communicates with lateral wall of the first channel 320 close to the first end 321.

Specifically, the accommodation space 101 may be integratedly molded with the main body 100, or the accommodation space 101 may be formed by enclosure of case. The accommodation space 101 accommodates circuit components of electronic cigarette 1000, wherein the circuit components include the power source 700 for energy storage, circuit board 600, and the trigger switch 200 that is communicatively connected to the circuit board 600. In some embodiments, the trigger switch 200 may be mounted inside the accommodation space 101 by the seal 300. For example, one end of the seals 300 communicates with both the sensing surface of the trigger switch 200, and the lateral wall of the first channel 320 of the seals 300. The trigger switch 200 may be an air trigger sensor for sensing the pressure of air to control the atomizing of juice by the atomizer 20, so as to facilitate the control on operation of electronic cigarette 1000.

It should be noted that the seal 300 can be an elastic part to facilitate the close fit between the seal 300 and the accommodation space 101 as well as avoid shaking when the seal 300 may be mounted into the accommodation space 101. In some embodiments, the seal 300 can be made of elastic material. In some embodiments, the seal 300 may be provided with an air flow sensing duct 310. In some embodiments, the sensing surface of the trigger switch 200 may be arranged toward the air flow sensing duct 310, and periphery of the trigger switch 200 may be closely fit with inner wall of the air flow sensing duct 310, which ensure the airtightness between the seal 300 and the trigger switch 200, so as to ensure the accuracy of controlling electronic cigarette 1000 by the trigger switch 200. In some embodiments, the seal 300 may be made of silicone material, rubber material, or polyurethane material, which is not limited in the present disclosure.

It should be noted that the seal 300 may be further provided with a first channel 320. In some embodiments, the first channel 320 includes two ends that are arranged oppositely, one end of the first channel 320 may be the first end 32, and the first end 321 communicates with outside through the air flow sensing duct 230 of the atomizer 20. In some embodiments, the second end 323 of the first channel 320 may be closed or communicate with outside, and the air flow sensing duct 310 closes to the first end 321 and communicates with side wall of the first channel 320. In some embodiments, the first channel 320 also play a role in supplementing air during operation of the electronic cigarette 1000, which ensures the normal operation of electronic cigarette.

In some embodiments, when the second end 323 of the first channel 320 is closed, leaking out juice in the atomizer 20 will accumulate at one end of the first channel 320 far away from the first end 321 under the guiding of the first channel 320 since the air flow sensing duct 310 may be arranged close to the first end 321, so as to prevent leaking out juice from flowing to the trigger switch 200 directly. In some embodiments, an oil-absorbing cotton may be further provided at the second end 323 of first channel 320 to further avoid accumulated juice entering the trigger switch 200. In some embodiments, when the second end 323 of the first channel 320 communicates with outside, leaking out juice may be discharged out of the power supply assembly 10 directly under the guiding of the first channel 320, which ensures the normal operation of the trigger switch 200.

After adopting above technical solution, a first channel 320 for juice flowing through may be provided and a first end 321 of the air flow sensing duct 310 close to the first channel 320 is set. For example, part of leaking out juice may be discharged or stored through the second end 323 of first channel 320, so as to avoid occurrence of juice at the trigger switch 200 and ensure the normal use of electronic cigarette 1000.

Figure 2:
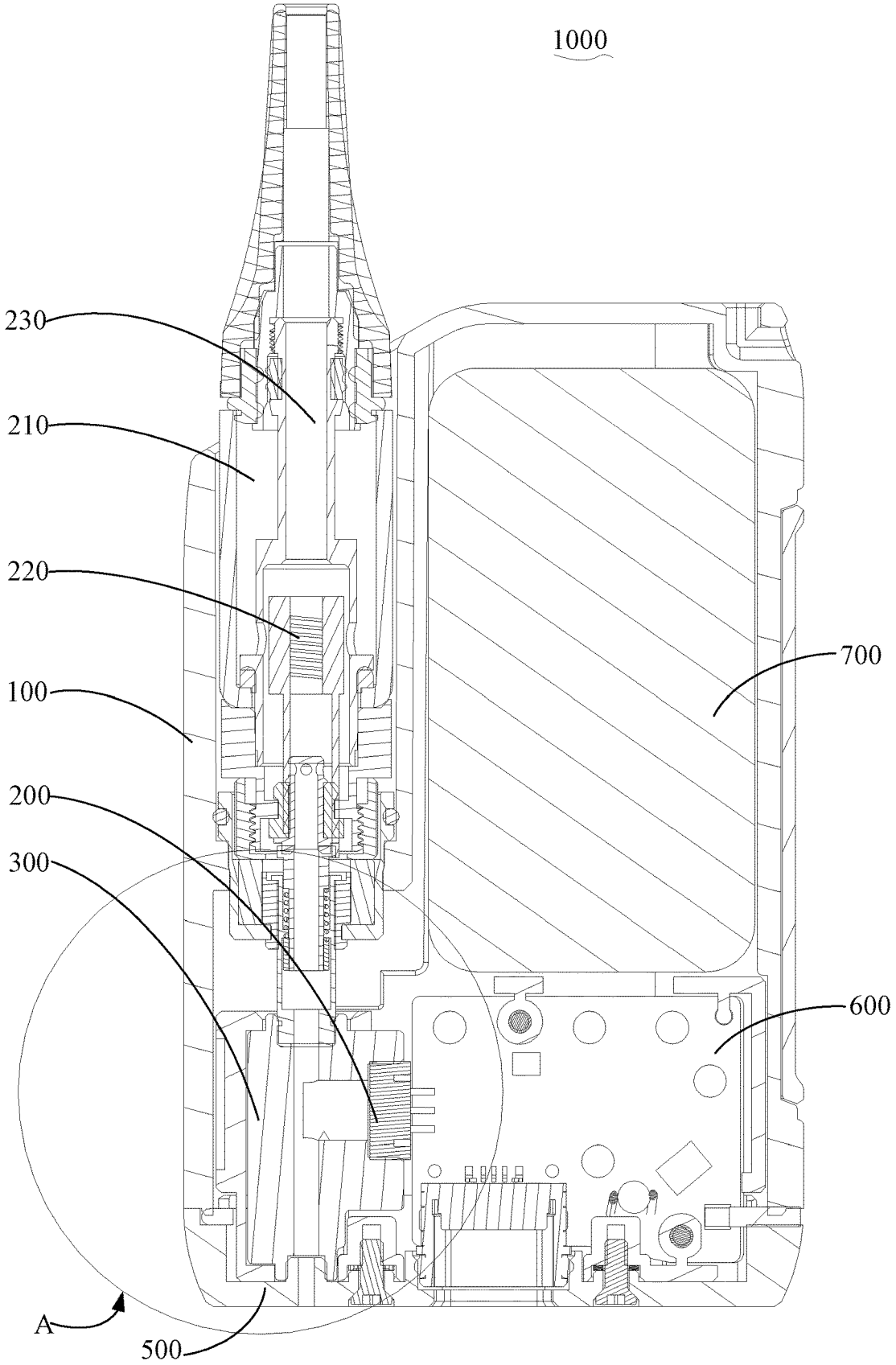
FIG. 2 is a sectional structural schematic of an electronic cigarette in the present disclosure.
Figure 3:
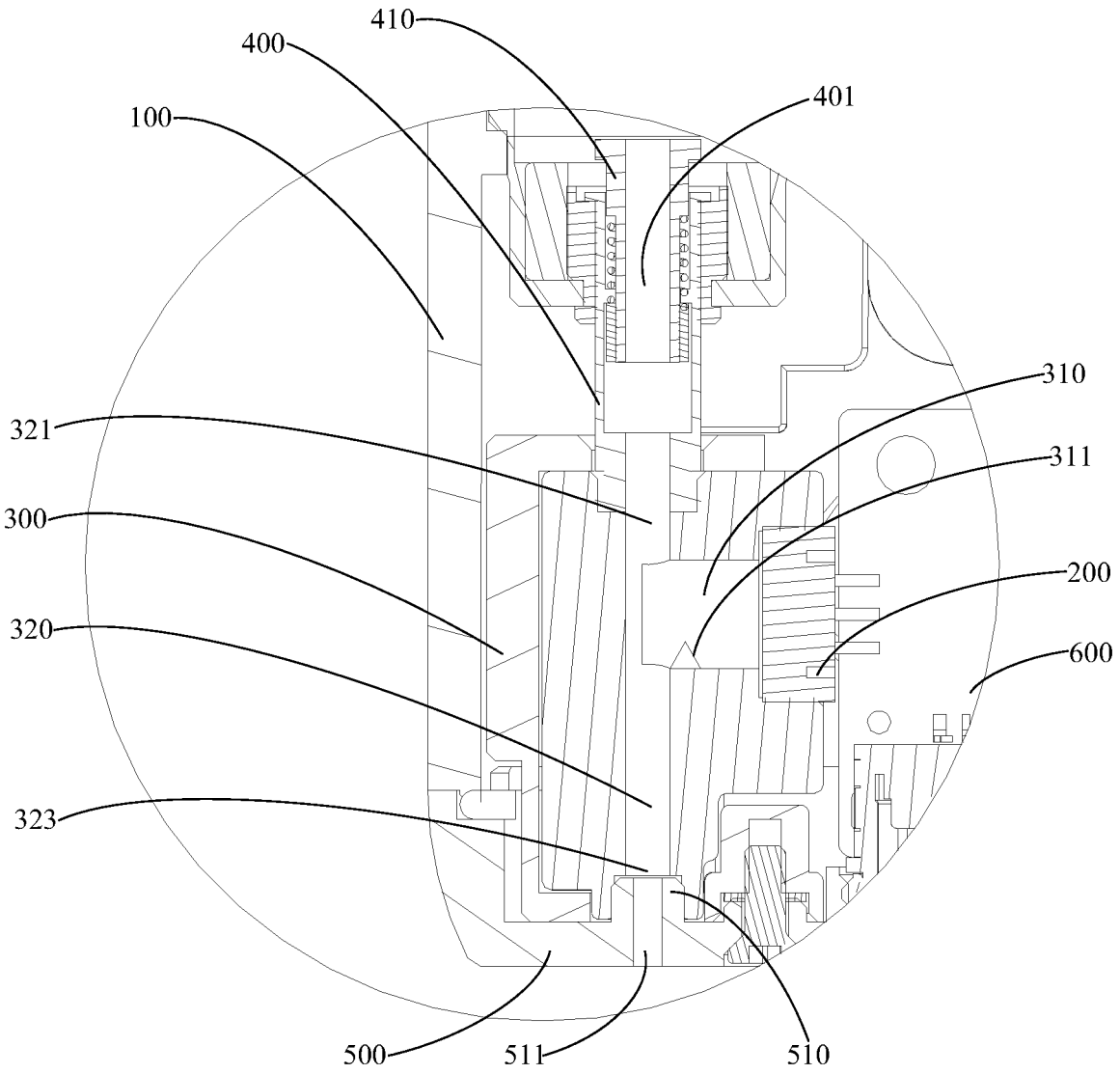
FIG. 3 is an enlarged structural schematic of the electronic cigarette in FIG. 2.
Figure 4:
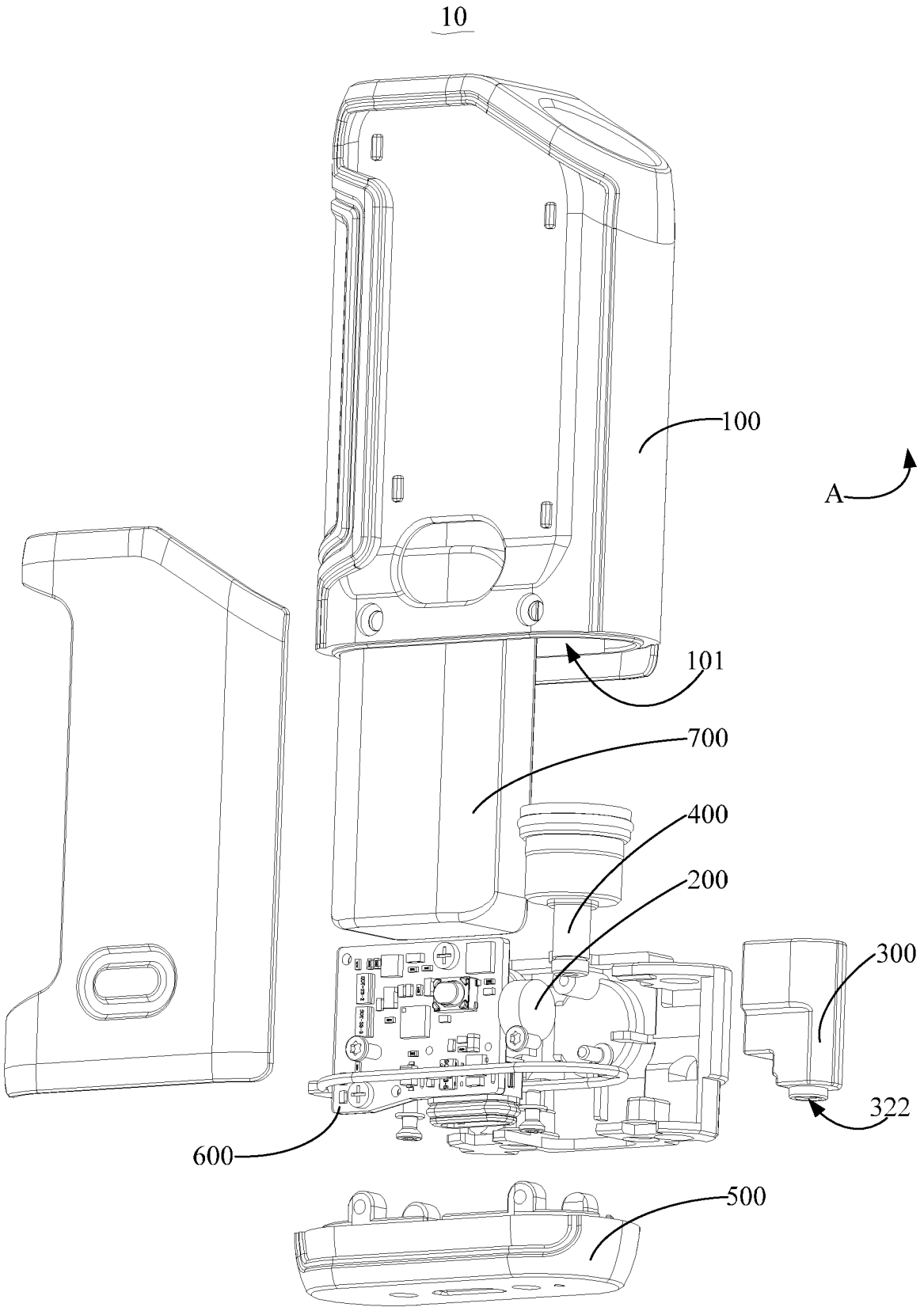
FIG. 4 is a disassembled structural schematic of the charging component in FIG. 1.

Further refer to FIG. 2 and FIG. 3, in an optional embodiment, the second end 323 of the first channel 320 communicates with outside. In this embodiment, two opposite ends of the first channel 320 both communicate with outside, so that the juice leaking out from the atomizer 20 of electronic cigarette 1000 can be directly discharged out of the power supply assembly 10 under the guiding of the first channel 320 to ensure the long term normal operation of trigger switch 200.

In some embodiments, when the second end 323 of the first channel 320 communicates with outside, a liquid-receiving groove may be further provided at the second end 323. The liquid-receiving groove may collect leaking out juice, wherein the liquid-receiving tank may be detachably connected to the first channel 320 to facilitate collecting and washing of leaving out juice, which prevents juice from directly discharging from the first channel 320 and dripping onto the user, and improve user experience through providing the liquid-receiving groove.

Figure 5:
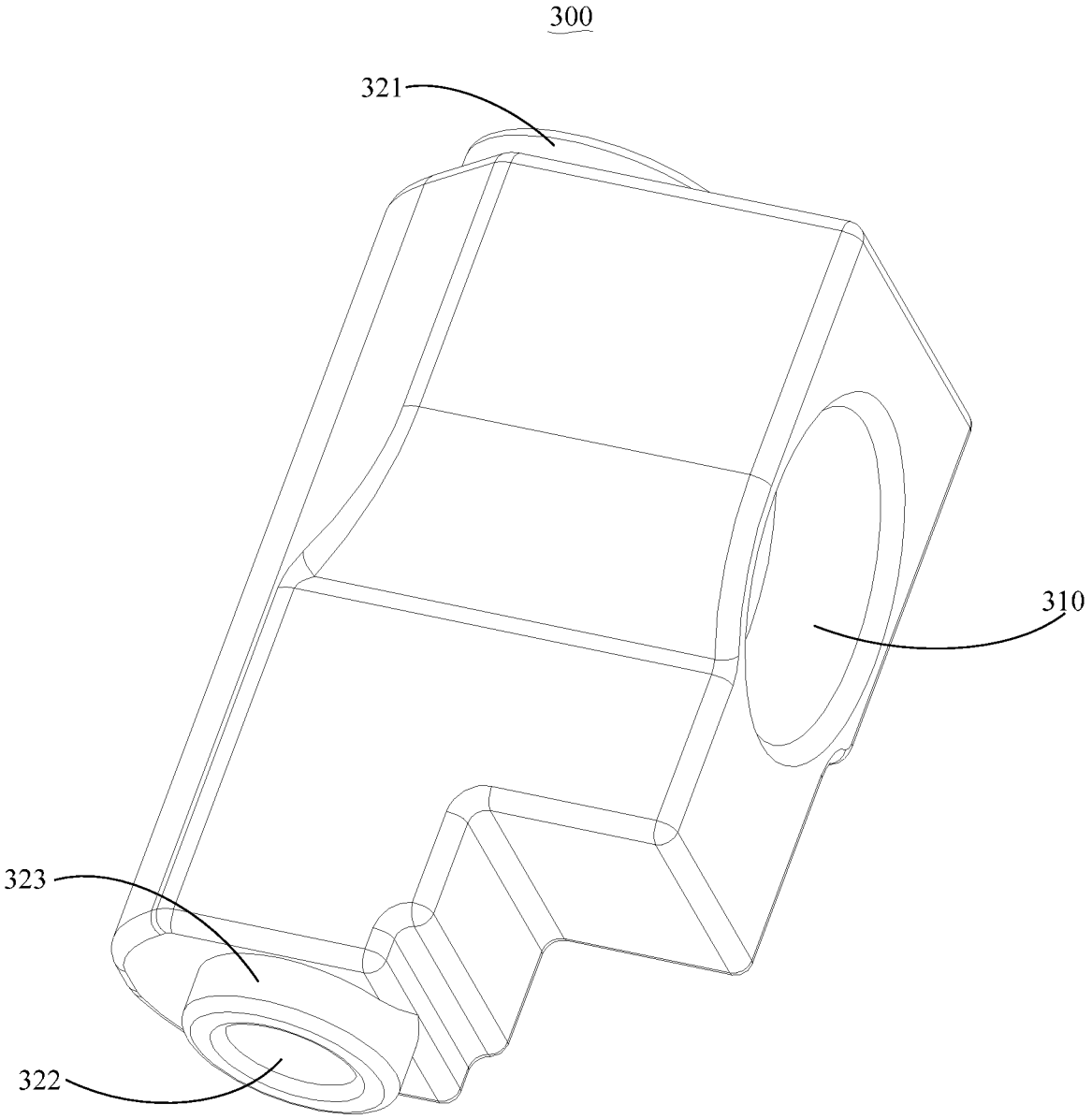
FIG. 5 is a structural schematic of a seal in FIG. 4.

With reference to FIG. 5, in an optional embodiment, the seals 300 may be silicone solid, and part or all the trigger switch is encapsulated in the seal. The first channel 320 may be arranged in a straight line. In this embodiment, the seals 300 may be an elastic part that is made of silicone, and the seals 300 may be arranged in square shape, the first channel 320 runs through the seals 300 along the long axis direction of the power supply assembly 10 in straight line, so as to facilitate the juice to flow through the first channel 320 and leave the power supply assembly 10. The air flow sensing duct 310 has two opposite ends. For example, one end of the air flow sensing duct 310 communicates with a lateral wall of the first channel 320 close to the first end 321, and the trigger switch 200 may be encapsulated in the seal 300 at the other end of the air flow sensing duct 310. The other end of the air flow sensing duct 310 may be tightly fit with the lateral wall of the trigger switch 200, so as to ensure the normal operation of the trigger switch 200.

With reference to FIG. 2 and FIG. 5, in an optional embodiment, the first channel 320 may be arranged along the long axis direction of the power supply assembly 10. In this embodiment, the first channel 320 may be arranged along vertical direction, so that under the influence of gravity, the leaking out juice in the atomizer 20 can be directly discharged out of the power supply assembly 10 under the guiding of the first channel 320. In some embodiments, the first channel 320 may be inclinedly arranged with respect to the horizontal plane. When the first channel 320 is inclinedly arranged with respect to the horizontal plane, the air flow sensing duct 310 will communicate with lateral wall of the first channel 320 along an oblique upward direction to prevent the juice in the first channel 320 from flowing into the air flow sensing duct 310, so as to reduce the possibility of juice's entering the trigger switch 200.

With reference to FIG. 2 and FIG. 3, in an optional embodiment, the air flow sensing duct 310 may be arranged in the direction perpendicular to the first channel 320. In this embodiment, the first channel 320 may be provided in cylindrical shape, and the air flow sensing duct 310 may be arranged along radial direction of the first channel 320. To prevent juice from moving to the trigger switch 200, the air flow sensing duct 310 may be arranged in the direction perpendicular to the first channel 320 to facilitate manufacture of the seal 300. In some embodiments, the air flow sensing duct 310 may also communicate with lateral wall of the first channel 320 along an oblique upward direction.

In an optional embodiment, an oil proof step 311 may be provided on one side of the air flow sensing duct 310 communicating with the first channel 320. In this embodiment, an oil proof step 311 may be provided on one side of the air flow sensing duct 310 connecting to the first channel 320 and far away from the first end 321, the oil proof step 311 may further prevent the juice in the first channel 320 from reaching the location of trigger switch 200. In some embodiments, the oil proof step 311 may be a liquid-guiding surface. The liquid-guiding surface arranged along an oblique upward direction and far away from the first channel 320, alternatively, the oil proof step 311 may be a convex platform 510 that may be arranged inside the air flow sensing duct 310.

With reference to FIG. 2-FIG. 5, in an optional embodiment, the power supply assembly 10 further includes a first electrode 400 with a first through hole 401. The first electrode 400 may be airtightly connected to the seals 300, and the first channel 320 communicates with outside through the first through hole 401. The power supply assembly 10 further includes a first electrode 400 electrically connected to the atomizer 20. The first through hole 401 may be provided on the first electrode 400, and the first electrode 400 communicates with the air suction channel 230 in the atomizer 20, so as to save the designed space required by the power supply assembly 10. In this embodiment, the first through hole 401 matches with the first channel 320 since the seals 300 may be made of elastic material. When the first electrode 400 tightly fit with the seals 300, the connection between the first electrode 400 and the seals 300 may be air-tight sealed, so that the first channel 320 can communicate with the air suction channel 230 of atomizer 20 through the first through hole 401.

It should be noted that a probe 410 may be further provided on one end of the first electrode 400 far away from the seals 300. The probe 410 may be conductively connected to the first electrode 400, and the probe 410 may be elastically connected to the first electrode 400 along axial direction through a spring, so that the probe 410 may move along the axial direction relative to the first electrode 400 to facilitate that the first electrode 400 can be conductively connected to the atomizer 20 through the probe 410.

In an optional embodiment, the main body 100 further includes a bottom cover 500. A convex platform 510 may be provided on the bottom cover 500, and a second through hole 511 that communicates with the first channel 320 may be provided on the convex platform 510, a groove 322 matching with the convex platform 510 may be provided on the seals 300, and the groove 322 matches with the convex platform 510, so that the bottom cover 500 may be airtightly connected to the seals 300.

In this embodiment, diameter of the air flow sensing duct 310 may be larger than that of the first channel 320, and diameter of the first channel 320 may be larger than that of the second through hole 511, so that the trigger switch 200 may sense change of air pressure to facilitate controlling the electronic cigarette 1000 by the trigger switch 200. The seals 300 may be made of elastic material, the convex platform 510 on the bottom cover 500 may be interferencely fitted with the groove 322 on the seals 300, so that the seals 300 and the bottom cover 500 may be connected tightly, which will avoid leakage of juice from the connection between the seal 300 and the bottom cover 500 to ensure the normal operation of trigger switch 200 and prevent pollution of internal working space in the power supply assembly 10.

It should be noted that, a buckle may be further provided on the inner wall of the main body 100, and the buckle may be buckled on the lateral side of the seals, so as to further fix the seal and avoid shaking.

With reference to FIG. 1 and FIG. 2, the present disclosure further discloses an electronic cigarette 1000. The electronic cigarette includes an atomizer 20 and a power supply assembly 10 for powering the atomizer 20. The atomizer 20 may be electrically connected to the power supply assembly 10, and air suction port of the atomizer 20 communicates with the first channel 320. Refer to above embodiment for specific structure of power supply assembly 10. The electronic cigarette 1000 adopts all the technical schemes of all above embodiments, therefore it can have at least all advantages brought by the technical schemes of the above embodiments, which will not be repeated here.

The above only describes preferred embodiments of present disclosure and is not intended to limit the patent scope of the present disclosure. Any equivalent structural transformation made by using contents of description and drawings of the present disclosure or directly or indirectly used in other relevant technical fields under the inventive concept of present disclosure shall be included within the protection scope of patent of the present disclosure.

The invention claimed is:

1. A power supply assembly for an electronic cigarette, the power supply assembly comprising:

a circuit component;

a main body that includes an accommodation space for accommodating the circuit component; and a trigger switch mounted inside the accommodation space by a seal, wherein the seal comprises a first channel and an air flow sensing duct that is connected to the trigger switch, the first channel includes a first end and a second end that are arranged oppositely, the first end is configured to communicate with an air suction pathway of an atomizer of the electronic cigarette, and the air flow sensing duct is configured to communicate with a lateral wall at the first end of the first channel.

2. The power supply assembly of claim 1, wherein the second end of the first channel is configured to communicate with outside of the electronic cigarette such that leaking out liquid can flow out of the power supply assembly through the first channel.

3. The power supply assembly of claim 1, wherein the first channel is arranged along a long axis direction of the power supply assembly.

4. The power supply assembly of claim 1, wherein the air flow sensing duct is arranged perpendicular to the first channel.

5. The power supply assembly of claim 1, wherein the air flow sensing duct comprises oil proof steps.

6. The power supply assembly of claim 1, wherein the seal comprises silicone, and at least part of the trigger switch is encapsulated in the seal.

7. The power supply assembly of claim 1, wherein the first channel is arranged in a straight line.

8. The power supply assembly of claim 1, wherein the power supply assembly further includes a first electrode with a first through hole, wherein the first electrode is airtightly connected to the seal, and the first channel is configured to communicate with outside of the electronic cigarette through the first through hole.

9. The power supply assembly of claim 1, wherein the main body further includes a bottom cover that includes a convex platform, wherein the convex platform includes a second through hole configured to communicate with the first channel, wherein the seal further includes a groove matching with the convex platform, and the groove matches with the convex platform such that the bottom cover is airtightly connected to the seal.

10. An electronic cigarette comprising:

an atomizer comprising an air suction port; and a power supply assembly electrically connected to the atomizer, the power supply assembly comprising:

a circuit component;

a main body that includes an accommodation space for accommodating the circuit component; and a trigger switch mounted inside the accommodation space by a seal, wherein the seal comprises a first channel and an air flow sensing duct that is connected to the trigger switch, the first channel includes a first end and a second end that are arranged oppositely, the first end is configured to communicate with an air suction pathway of an atomizer of the electronic cigarette, and the air flow sensing duct is configured to communicate with a lateral wall at the first end of the first channel, wherein the air suction port of the atomizer is configured to communicate with the first channel of the seal.

11. The electronic cigarette of claim 10, wherein the second end of the first channel is configured to communicate with outside of the electronic cigarette such that leaking out liquid can flow out of the power supply assembly through the first channel.

12. The electronic cigarette of claim 10, wherein the first channel is arranged along a long axis direction of the power supply assembly.

13. The electronic cigarette of claim 10, wherein the air flow sensing duct is arranged perpendicular to the first channel.

14. The electronic cigarette of claim 10, wherein the air flow sensing duct comprises oil proof steps.

15. The electronic cigarette of claim 10, wherein the seal comprises silicone, and at least part of the trigger switch is encapsulated in the seal.

16. The electronic cigarette of claim 10, wherein the first channel is arranged in a straight line.

17. The electronic cigarette of claim 10, wherein the power supply assembly further includes a first electrode with a first through hole, wherein the first electrode is airtightly connected to the seal, and the first channel is configured to communicate with outside of the electronic cigarette through the first through hole.

18. The electronic cigarette of claim 10, wherein the main body further includes a bottom cover that includes a convex platform, wherein the convex platform includes a second through hole configured to communicate with the first channel, wherein the seal further includes a groove matching with the convex platform, and the groove matches with the convex platform such that the bottom cover is airtightly connected to the seal.

* * * * *